US005397014A

United States Patent [19]

Aydt

[11] Patent Number: 5,397,014

[45] Date of Patent: Mar. 14, 1995

[54] DUAL APERTURE RETAINED TAB

[76] Inventor: Robert Aydt, 3040 Savannah Way #102, Melbourne, Fla. 32935

[21] Appl. No.: 172,608

[22] Filed: Dec. 22, 1993

[51] Int. Cl.[6] ..... B65D 17/34

[52] U.S. Cl. ..... 220/269; 220/271

[58] Field of Search ..... 220/269, 271

[56] References Cited

U.S. PATENT DOCUMENTS

| | | | |
|---|---|---|---|
| 3,307,737 | 3/1967 | Harvey et al. | 220/271 |
| 3,326,406 | 6/1967 | Brown | 220/269 |
| 3,970,212 | 7/1976 | Brown | 220/269 |
| 4,073,403 | 2/1978 | Orange | 220/269 |
| 4,213,538 | 7/1980 | Boardman | 220/271 X |
| 4,252,247 | 2/1981 | Asbury | 220/268 |
| 4,872,597 | 10/1989 | Hanafusa | 220/269 X |
| 5,011,037 | 4/1991 | Moen et al. | 220/271 |

FOREIGN PATENT DOCUMENTS

| | | | |
|---|---|---|---|
| 2342423 | 3/1974 | Germany | 220/271 |

*Primary Examiner*—Gary E. Elkins
*Assistant Examiner*—Stephen Cronin
*Attorney, Agent, or Firm*—Warren L. Franz

[57] ABSTRACT

Non-detachable lever lift tabs for opening a beverage container is improved by changing the fulcrum or pivot point to a central position within the area of the lifting tab. This enables the tab to be utilized twice, once in each direction. The tab now offers a 100% increase in potential utility. This "teeter-totter" action allows the operator to open a diametrically opposed hole. This second aperture ventilates and significantly improves the air flow and pour rate of the contained beverage.

1 Claim, 3 Drawing Sheets

FIG. 1
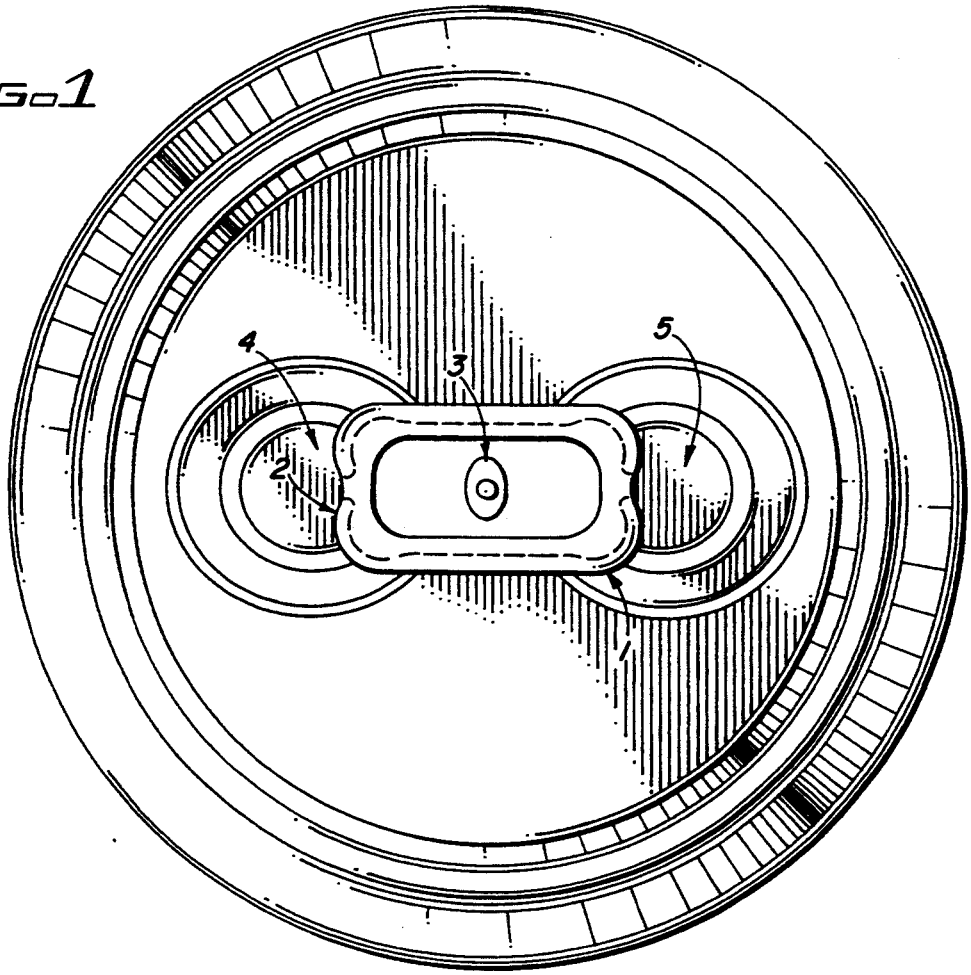
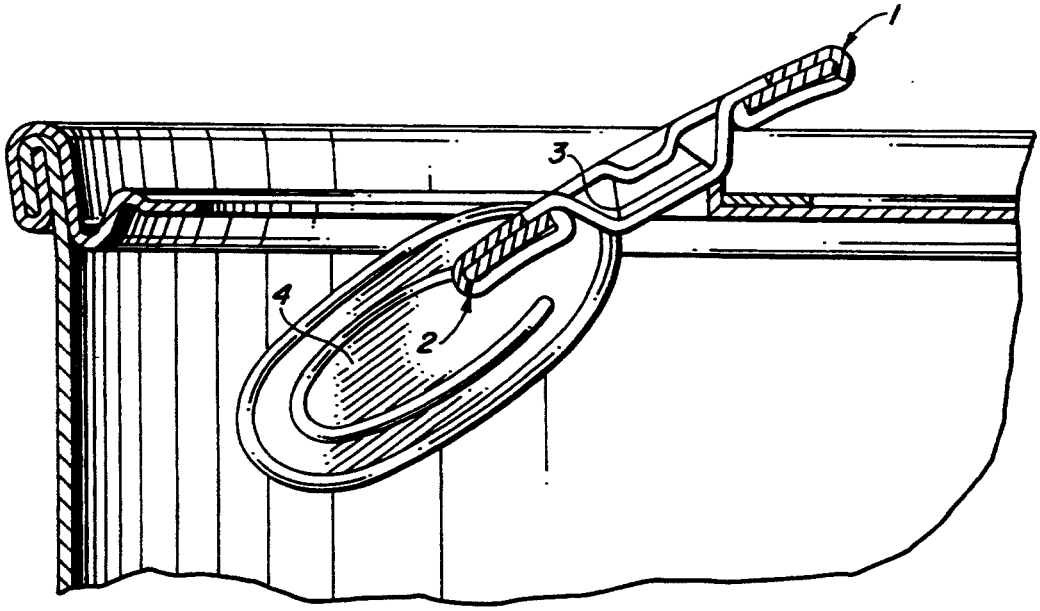
FIG. 2

DUAL APERTURE RETAINED TAB

This invention relates to tabs for metal beverage containers; and, more particularly, to non-removable fulcrum, leverage type lift tabs.

BACKGROUND OF THE INVENTION

Single aperture opening beverage cans utilize a single large hole to admit air for venting the dispensed liquid. Examples are given in U.S. Pat. Nos. 4,210,257; 5,007,554; 4,416,389; 4,148,410; 4,465,204; and 4,361,251, the disclosures of which are incorporated herein by reference.

In order to produce a more efficient, controlled flow rate, it is desirable to have a second hole that is diametrically opposite the first aperture. This is especially advantageous for carbonated and malt beverages such as beer. This enables users to control rate of direct consumption, pouring and consequent foam head. Prior to large holed single aperture lift tab cans, beer cans were typically opened with "Church Keys", applied first to one side, then to the opposite side of the can top. This was done in order to increase the flow rate of the beverage and for better control of the liquid stream.

SUMMARY OF THE INVENTION

It is an object of current invention to facilitate the opening of a container having a non-detachable fulcrum riveted lift tab. It is the object of this invention to add a second aperture which would allow for air venting and more efficient controlled pouring. It is further object that by changing the position of the fulcrum both apertures may be easily opened in a teeter-totter manner. In addition, the second aperture can also be opened, without modification to the tab, by rotating the tab in a circular direction around the fulcrum or pivot point. This increased utility and efficiency are described by the related drawings.

In accordance with the invention, a non-detachable lift tab consists of an elongated rectangular strip of aluminum with rounded edges. The sides are rolled over for injury prevention and structural integrity. The tab is riveted at the center and centrally crimped, allowing the tab to be lifted from either side. The lifting force from one side causes contact with the scored and weakened pouring panel section of the can's top surface. Continued pressure against this panel causes it to separate and open along the scored surface. This method is repeated by rocking or pivoting the tab over the fulcrum in a teeter-totter motion in order to break open the second aperture. The second aperture may also be opened or accessed by rotating the tab in a circular direction, clockwise or counter-clockwise around the rivet or fulcrum point. This utilizes the same tab edge as the contact edge for opening both scored pour panel apertures. The holes may be of varying size depending on the consistency and viscosity of the contained beverage.

BRIEF DESCRIPTION OF THE DRAWINGS

Embodiments of the invention have been chosen for purposes of illustration and description, and are shown in the accompanying drawings, wherein:

FIG. 1 is a top plan view of a container top utilizing a tab in accordance with the invention;

FIG. 2 is an enlarged fragmentary sectional view with the tab raised in order to displace or open the pour panel inwardly;

Throughout the drawings, like elements are referred to by like numerals.

DETAILED DESCRIPTION OF PREFERRED EMBODIMENT

As shown in FIG. 1, the innovative tab design is central to the can membrane. The tab center or core 3 is the fulcrum or pivot point attachment by which the tab is attached to the top membrane of the container. The tab's symmetrical ends 1 and 2 may be raised in either direction causing the opposite end 1 or 2 to make contact with a scored pour panel 4 and 5. Continued lifting of either side will result in greater applied force and pressure on the opposite scored panel until separation of the pour panel from the top membrane of the container occurs. It is then possible to rock the tab backward, in a motion opposite the first action, which causes the opposite tab end 1 or 2 to strike against the diametrically opposed aperture. The result, consistent with the first action, separates pour panel and membrane. The tab may now be returned to its original or nested position.

Figure 3:
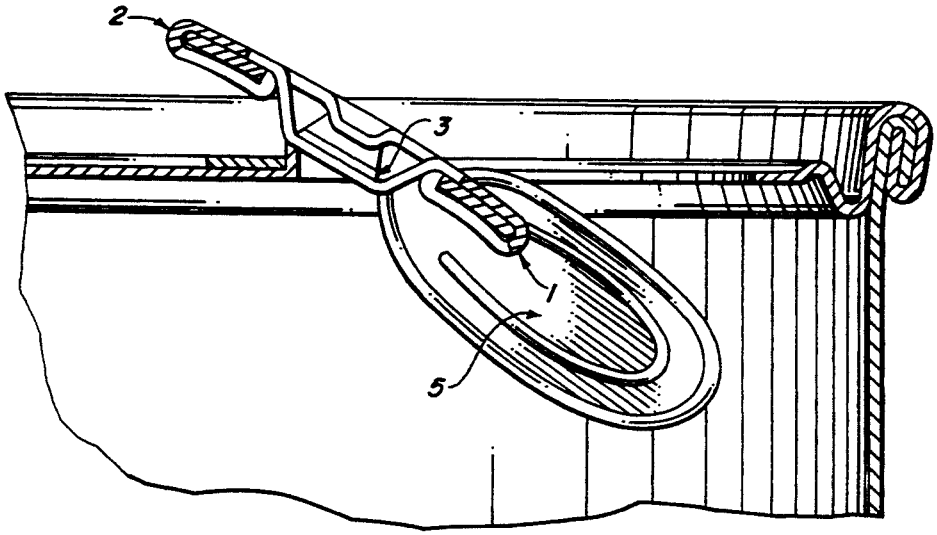
FIG. 3 is an enlarged fragmentary sectional view of a diametrically opposed pour panel with the tab raised in order to displace or open the pour panel inwardly.
Figure 4:
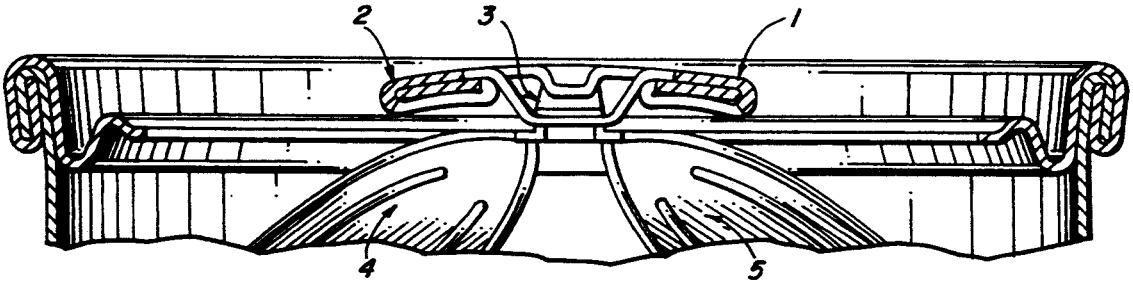
FIG. 4 is an enlarged fragmentary sectional view with the tab in its original, neutral position, before or after opening the pour panels.
Figure 5A:
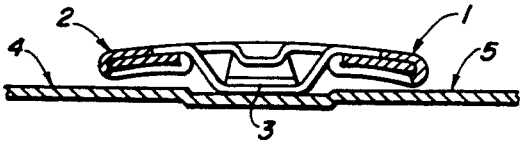
FIGS. 5A–5E are cross-sectional views of the tab of FIG. 1, showing, in sequence, successive positions of the tab and pour panel of the first aperture.
Figure 6A:
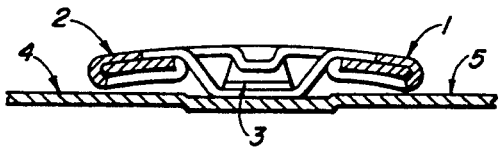
FIGS. 6A–6E are cross-sectional views of the tab of FIG. 1 showing, in sequence, successive positions of the tab and diametrically opposed panel and second pour panel.
Figure 5B:
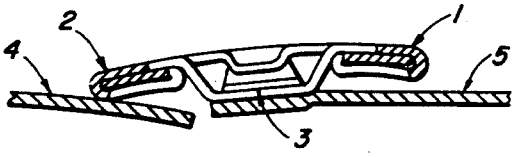
Figure 6B:
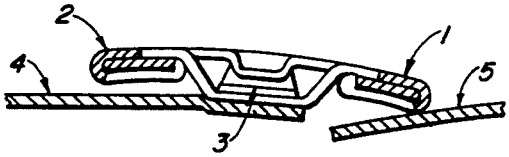
Figure 5C:
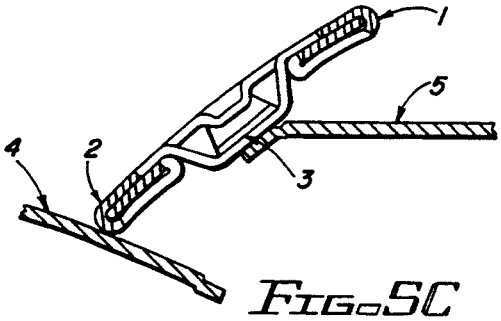
Figure 6C:
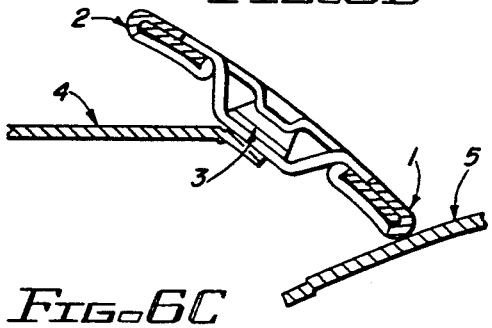
Figure 5D:
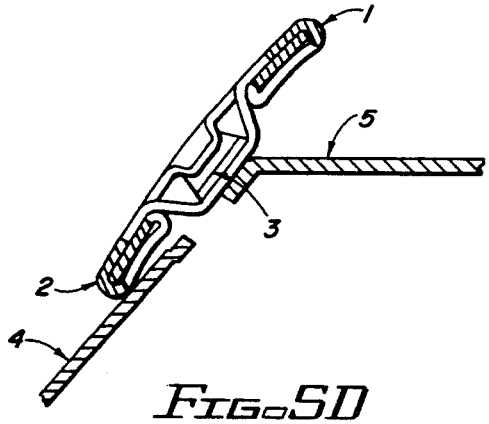
Figure 6D:
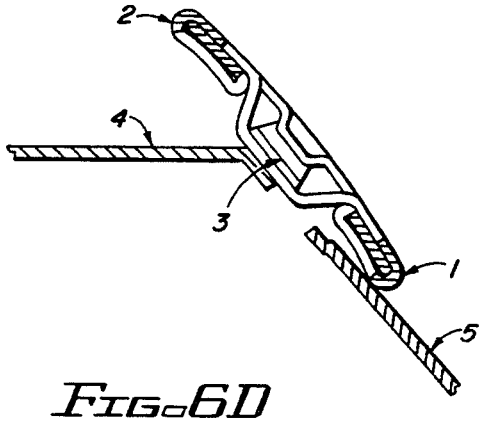
Figure 5E:
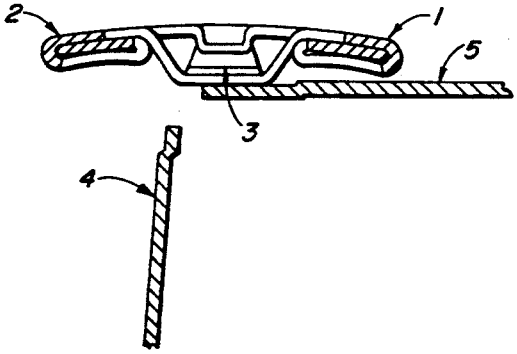
Figure 6E:
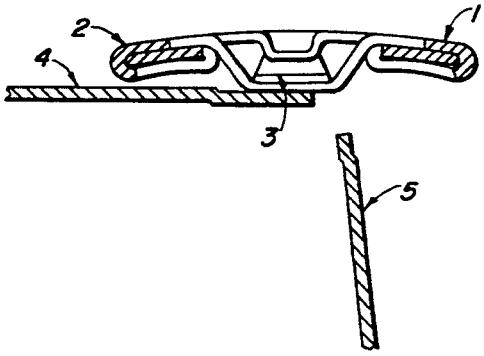

FIG. 2 represents a cross-sectional view of the embodiment described. In this figure, the tab end 2 has made contact with the pour panel 4 and caused separation, creating a hole along the score line, enabling the beverage to be dispensed from the container. The tab 1 has been raised away from the container's top membrane and pivoted over 3 the rivet or fulcrum which creates leverage and the necessary pressure to separate the pour panel. The tab may then be rocked back in a teeter-totter manner as in FIG. 3 which illustrates the tab's 100% increase in utility by repeating the steps to open pour panel 5. As with the opening of pour panel 4, the end of the tab 1 creates enough pressure against the pour panel 4 to cause separation. This is achieved by lifting the opposite end of the tab 2 away from the top surface or membrane of the container. FIG. 4 illustrates a cross-sectional view of the same can after both apertures have been separated from the top membrane or lid of the container, leaving two holes or apertures on the container's surface. The tab 2 and 1 is returned to its original nested position with the 3 fulcrum in a neutral position. FIGS. 5A–5E illustrate the improved tab and the progression by which the initial aperture is struck and consequently opened with increased tab pressure along the fulcrum or pivot point. FIGS. 6A–6E are representative of the action stages or successive stages by which a mirrored or diametrically opposed aperture may be opened, using the same principles as those illustrated by FIGS. 5A–5E.

A second aperture is a significant improvement to existing beverage containers. It enables more efficient, smoother dispensing of the contained beverage. The second hole also allows a more sanitary means for two persons to share a beverage. The new tab design results in an 100% increase in the tool's utility. The second aperture may also be opened utilizing current tab design by rotating the tab in a clockwise direction around the pivot point or fulcrum. Both tab uses and designs are a dramatic improvement to current applications when combined with a second aperture or venting hole.

Those skilled in the art to which the invention relates will appreciate that other substitutions and modifications can be made to the described embodiment, without departing from the spirit and scope of the invention as described by the claims below.

What is claimed is:

1. A method for opening a beverage container comprising the steps of raising a first end of a non-detachable lever lift tab attached at a central fulcrum on a top of the beverage container to cause an opposite second end of the tab to break a first scored panel on the container top, so as to open a first aperture in the top; and raising an opposite second end of the tab to cause the first end to break a diametrically opposed second scored panel on the container top, so as to open a diametrically opposed second aperture in the top; the tab being manipulated in teeter-totter action about the fulcrum; the first aperture providing an opening for pouring out the contents of the container; and the second aperture providing ventilation for air flow into the container for control of the pouring.

* * * * *